United States Patent [19]

Takeuchi et al.

[11] Patent Number: 4,901,660

[45] Date of Patent: Feb. 20, 1990

[54] PATTERN-MATCHING SEWING MACHINE

[75] Inventors: Hirokazu Takeuchi; Hirosumi Itoh; Shigeru Suzuki, all of Nagoya; Etsuzo Nomura, Kasugai, all of Japan

[73] Assignee: Brother Kogyo Kabushiki Kaisha, Aichi, Japan

[21] Appl. No.: 330,909

[22] Filed: Mar. 31, 1989

[30] Foreign Application Priority Data

Apr. 6, 1988 [JP] Japan ..... 63-84933

[51] Int. Cl.[4] ..... D05B 27/06; D05B 27/08

[52] U.S. Cl. ..... 112/314; 112/121.11; 112/320

[58] Field of Search ..... 112/314, 313, 312, 315, 112/316, 121.11, 272, 153, 121.26, 320, 306

[56] References Cited

U.S. PATENT DOCUMENTS 4,363,281 12/1982 Reinke ..... 112/121.11
4,612,867 9/1986 Rösch et al. ..... 112/314
4,757,773 7/1988 Nomura ..... 112/121.11
4,766,828 8/1988 Nomura et al. ..... 112/314
4,777,896 10/1988 Nomura ..... 112/314

FOREIGN PATENT DOCUMENTS 3346163 12/1983 United Kingdom .
2193806 8/1986 United Kingdom .

*Primary Examiner*—Peter Nerbun
*Attorney, Agent, or Firm*—Oliff & Berridge

[57] ABSTRACT

A pattern-matching sewing machine having a feed-correcting means for accurately adjusting feed amount using a correction factor with three values which are set according to various sewing conditions such as species of cloths and a speed of a main motor. When the feed amount for pattern matching is calculated based on only a mismatch distance detected by a photo-sensor, the accurate pattern matching is not achieved due to the various sewing conditions. Therefore, the feed-correcting means selects the optimum one of the three values to accurately correct the feed amount for a good pattern matching.

4 Claims, 17 Drawing Sheets

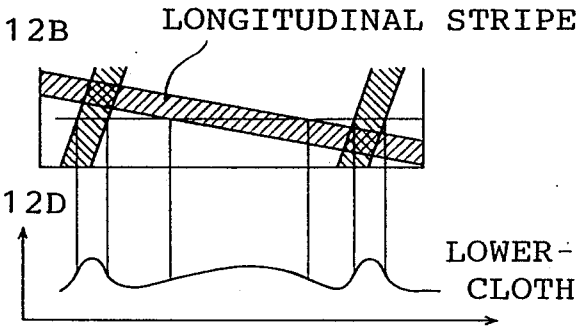
FIG. 12B
FIG. 12D
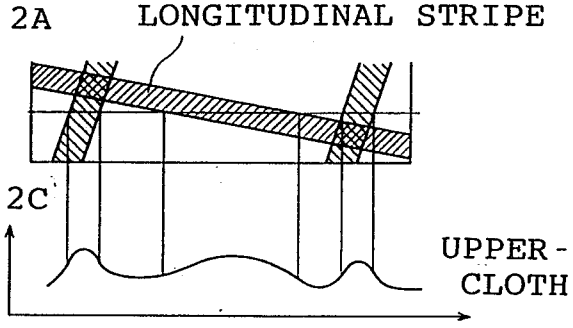
FIG. 12A
FIG. 12C

DIFFERENTIATED DATA

PATTERN-MATCHING SEWING MACHINE

BACKGROUND OF THE INVENTION

This invention relates to a pattern-matching sewing machine, for sewing two sheets, such as cloths, each bearing the same patterns with the patterns matching.

Published Unexamined Japanese Patent Application No. S60-153896 (which corresponds to the U.S. Pat. No. 4,612,867, and the German Patent Application DE 33 46 163 C1) discloses a pattern-matching sewing machine of this type. In this machine, a pair of photo-sensors are placed before the sewing point to generate intensity data representing the brightness of the patterns on the two cloths. When the two cloths are fed for sewing, the mismatch distance of the patterns on the two cloths is detected using the intensity data, and the feed amount for at least one of the two cloths is gradually adjusted according to the mismatch distance to maintain the pattern match.

However, even if feed amount is given to the cloths based on the calculated mismatch distance, some species of cloths have hard-to-match patterns. This is because the set feed amount of the feed dog may not be the actual feed amount of the cloths, or because the actual feed amount changes according to various sewing conditions, even if the set feed amount is constant.

FIG. 17 shows the data for explaining the above situation where: two superposed cloths are sewn 450 mm under the conditions that lower feed amount of a lower feed dog is fixed at 2 mm per feed, while upper feed amount of an upper feed dog is varied, and then the mismatch distance between the two cloths is measured. Four kinds of cloths, (i.e., thick woolen cloth A, normal woolen cloth B, thin woolen cloth C, and non-woolen thin cloth D are measured. The mismatch distance of A, B, C, and D becomes zero when their upper feed amounts are set at 1.32 mm, 1.48 mm, 2.12 mm, and 2.88 mm, respectively. The slope of the curve in the vicinity of zero mismatch distance is largest in D, followed by C, B, and A. Therefore, in the case of the cloth D, a slight change in the upper feed amount increases the mismatch distance.

The difference between the preset upper-feed amount and the actual feed amount varies according to the species of cloths. For one cloth, a long-distance sewing is necessary to return the mismatch distance to zero as shown in FIG. 16A, and for another cloth the mismatch distance fluctuates, as shown in FIG. 16B. Thus the quality of the sewn products is unstable.

Further, even when the same species of cloths are sewn, the difference between the set upper feed amount and the actual upper feed amount is also caused by differences in: rotation speed of a main motor, shape of an upper feed dog or a presser foot, or pressure of the presser foot.

SUMMARY OF THE INVENTION

An object of this invention is therefore to provide a pattern-matching sewing machine that can match the patterns smoothly and accurately under various sewing conditions.

The machine according to the present invention for sewing two sheets having the same pattern with the patterns matching comprises, as shown in FIG. 1: a sewing means M1 for sewing two sheets having the same pattern; a first and second feeding means M2 each for intermittently feeding one of the sheets; a first and second photo-sensing means M3 each for optically sensing the pattern on one of the sheets during feeding and for generating photo-intensity data at a plurality of points on the sheet; a mismatch detecting means M4 for calculating a mismatch distance of patterns on the two sheets from the data sensed by the first and second photosensing means; a feed-adjusting means M5 for adjusting amount fed by at least one of the feeding means based on the calculated mismatch distance to match the patterns; and a feed-correcting means M6 for correcting the feed amount adjusted by the feed-adjusting means according to sewing conditions.

In the present invention, the sewing conditions are: species of sheets, thickness of sheets, sewing speed based on a rotation of a main motor of the sewing machine, whether a separator is set between the two sheets to avoid their mutual interference, shape of upper and lower feed dogs, or a presser foot, pressure of a pressure foot, sewing patterns such as a straight or a curving pattern.

BRIEF EXPLANATION OF THE DRAWINGS

FIGS. 12A and 12B illustrate example patterns on the upper and lower cloths, respectively.

FIGS. 12C and 12D illustrate smoothed data for the upper and lower cloths, respectively.

DETAILED DESCRIPTION OF PREFERRED EMBODIMENTS

Figure 2:
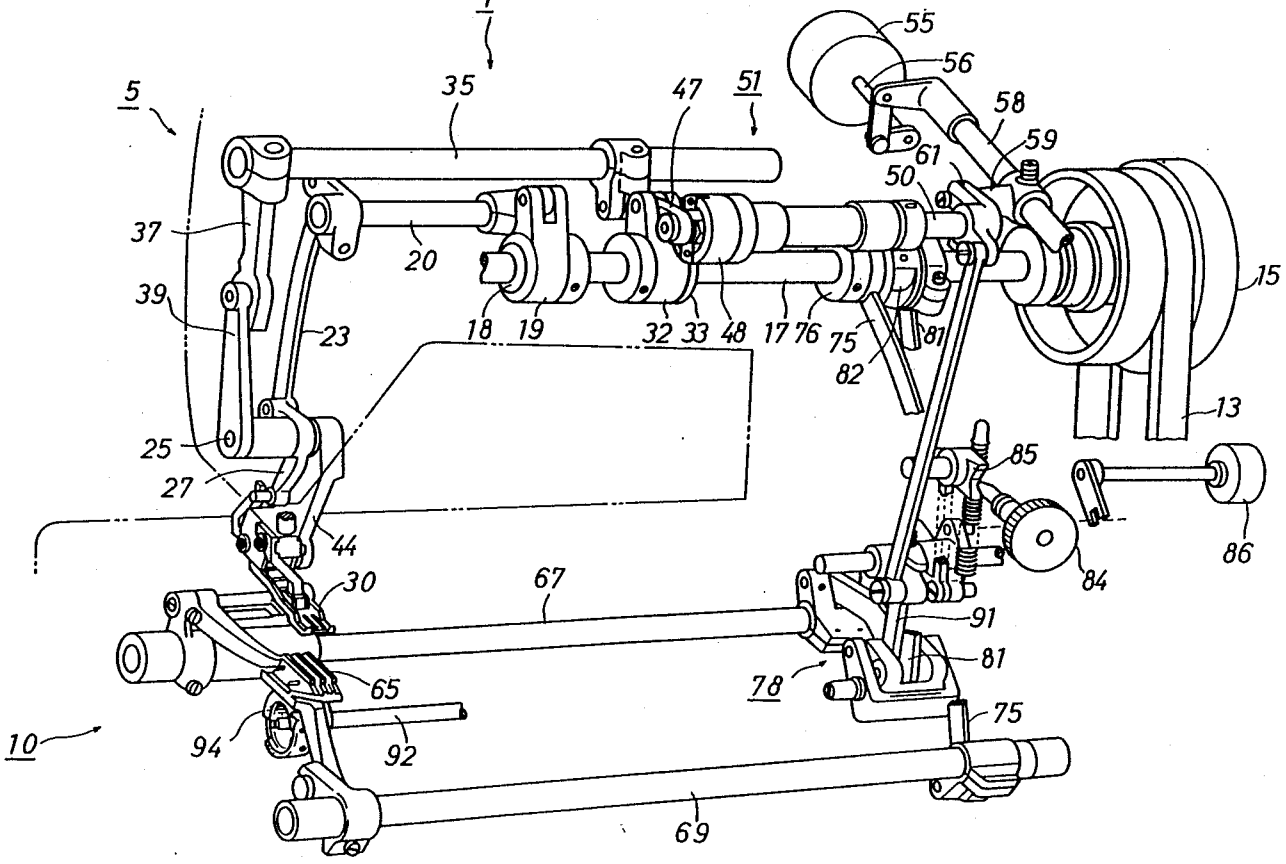
FIG. 2 schematically illustrates the mechanical structure of a sewing machine embodying the invention.

FIG. 2 illustrates a sewing machine 1 as an embodiment of the present invention. This sewing machine 1 is controlled by a microcomputer to sew two cloths having the same pattern so their patterns match. The mechanical structure of the sewing machine 1 is explained first.

The sewing machine 1 includes an arm part 5 and a bed part 10. The arm part 5 includes a main shaft 17 that is driven by a main motor 190 (FIG. 4) via a belt 13 and a pulley 15. The main shaft 17 has an eccentric cam 18 that connects to a working shaft 20 via a crank rod 19. Thus the working shaft 20 rocks through a predetermined angle with the rotation of the main shaft 17 and gives a connection link 23 a vertical motion. The connection link 23 connects to an arm 27 that swings about a support shaft 25. The swinging motion of the arm 27 gives an upper feed dog 30 vertical motion.

The main shaft 17 connects, via a crank rod 32, another eccentric cam 33, and a link 47, to a working shaft 35. The working shaft 35 rocks through a predetermined angle according to the rotation of the shaft 17 to impart a swinging motion to levers 37 and 39. The lever 39 is articulated with an arm 44 which swings about the shaft 25. The swinging motion of the arm 44 imparts a stroke drive to the upper feed dog 30. Thus the upper feed dog 30 makes a four-motion feed: up, forward, down, and backward.

The stroke motion amount of the upper feed dog 30 (i.e., the feed amount of the upper cloth) is determined by the rocking motion amount of the shaft 35. The link 47 connects to an upper feed adjuster 48 fit on one end of a rotary shaft 50. The adjuster 48 changes the rocking motion amount of the shaft 35 by changing the inclination of the link 47. The crank rod 32, eccentric cam 33, link 47, upper feed adjuster 48 and rotary shaft 50 form an upper feed adjusting mechanism 51.

At the other end of the shaft 50 is a rotary lever 61 with two oppositely extending arms. One arm abuts on a stopper 59 attached to a drive shaft 58 that is connected to an output shaft 56 of a step motor 55. Accordingly the step motor 55 moves the stopper 59, the stopper 59 regulates the lever 61, and the lever 61 limits the rotating position of the shaft 50 and determines the rocking angle of the shaft 35. The upper feed amount is thus adjusted.

The bed part 10 includes a horizontal feed shaft 67 and a vertical feed shaft 69 for making a lower feed dog 65 into four-motion feed like the upper feed dog 30. The vertical feed shaft 69 is connected, via a crank rod 75 and an eccentric cam 76, to the main shaft 17, and rocks through a predetermined angle with the rotation of the shaft 17 to give the lower feed dog 65 a vertical motion. The horizontal feed shaft 67 is connected, via a lower feed adjuster 78, a crank rod 81, and the eccentric cam 82, to the main shaft 17, and rocks through a predetermined angle with the rotation of the main shaft 17 to give the lower feed dog 65 a horizontal motion. The lower feed adjuster 78 converts the longitudinal motion of the crank rod 81, which is driven by the rotation of the main shaft 17, to the rocking motion of the horizontal feed shaft 67, and regulates the rocking distance.

A manual feed control knob 84 is provided outside of the frame of the sewing machine 1 to adjust the inclination of a feed set notch 85 against which the end of the knob 84 abuts. The notch 85 is connected to the adjuster 78 via a link 91. When its inclination is changed, the feed amount is changed by the lower feed adjuster 78. The lower feed amount thus can be changed by the manual feed control knob 84. The notch 85 also connects to a potentiometer 86 that generates a signal corresponding to the lower feed amount.

Figure 3:
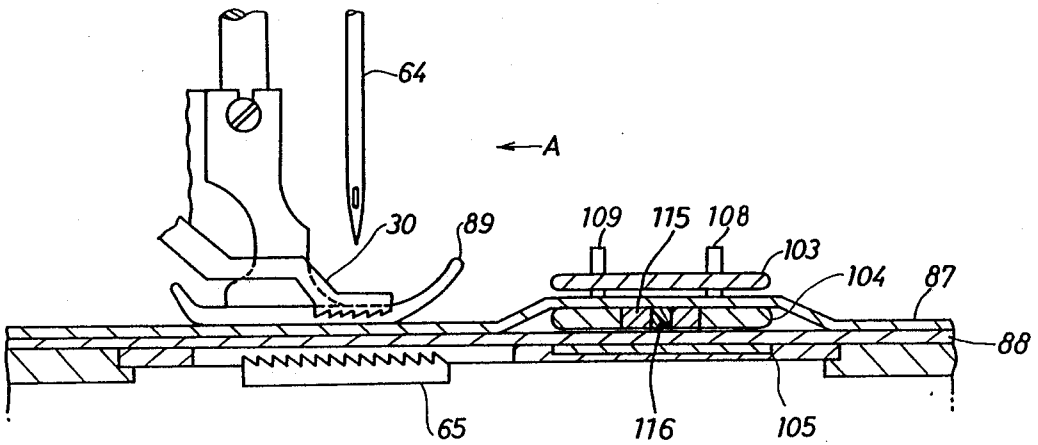
FIG. 3 illustrates the stitching section of the sewing machine.

A needle 64 (FIG. 3) is attached to a needle bar (not shown) which moves vertically synchronously with the main shaft 17. Within the bed part 10 below the needle 64 is a loop taker 94 attached to a lower shaft 92 which also rotates synchronously with the main shaft 17. Accordingly, at the sewing part (FIG. 3), synchronously with the rotation of the main shaft 17, the needle 64 and the loop taker 94 cooperate to sew together two cloths 87, 88 set under a presser foot 89, and the upper and the lower feed dogs 30 and 65 feed them in direction A (FIGS. 3 and 4) with the four-motion feed. After sewing, a thread-cutter solenoid 98 (FIG. 4) drives a thread cutter (not shown).

Upstream of the sewing part, three guide plates 103, 104, and 105 are placed in parallel to the machine bed, in which the lower guide plate 105 is embedded. Two pins 108 and 109 (FIGS. 3 and 4) stand upward on the lower guide plate 105 to penetrate long holes formed in the middle and upper plates 104 and 103, and guide the side edges of the cloths 87 and 88.

Figure 5A:
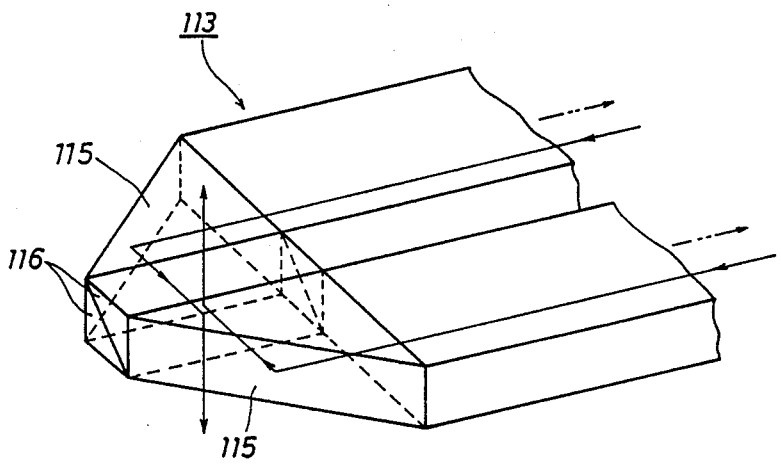
FIGS. 5A and 5B illustrate an end of the pattern detector and an internal structure of its light conduit.
Figure 5B:
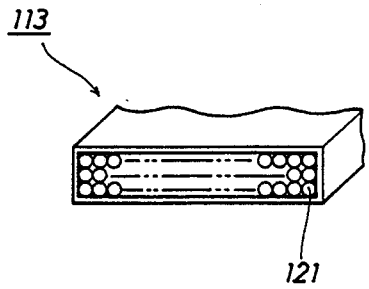

A detector 113 for detecting patterns on the two cloths 87 and 88 is embedded in the middle guide plate 104. As shown in FIG. 5A, prisms 115 and 116 are attached at the tip of the detector 113. Light from a conduit is reflected by the prisms 115 and 116 to the cloths 87 and 88, and the light reflected by the surfaces of the cloths 87 and 88 retraces the incident path. As shown in FIG. 5B, the conduit in the detector 113 includes a bundle of optical fibers 121 that connects to a control box 124 of the sewing machine 1.

The optical fibers 121 include fibers 127 (FIG. 4) for projecting the light, and fibers 129 and 131 for receiving the light. The projecting fibers 127 communicate with a light source unit 133, and the receiving fibers 129 and 131 with photo-sensors 144 and 148, in the control box 124. In the light source unit 133, a lamp 141 projects white light into the fibers 127 through a lens 138. The fibers 129 and the photo-sensor 144 correspond to the upper cloth 87, and the fibers 131 and the photo-sensor 148 correspond to the lower cloth 88.

The photo-sensors 144 and 148 receive the light and generate its intensity data. The intensity data is sent to an electronic control unit 160 built within the control box 124.

Figure 4:
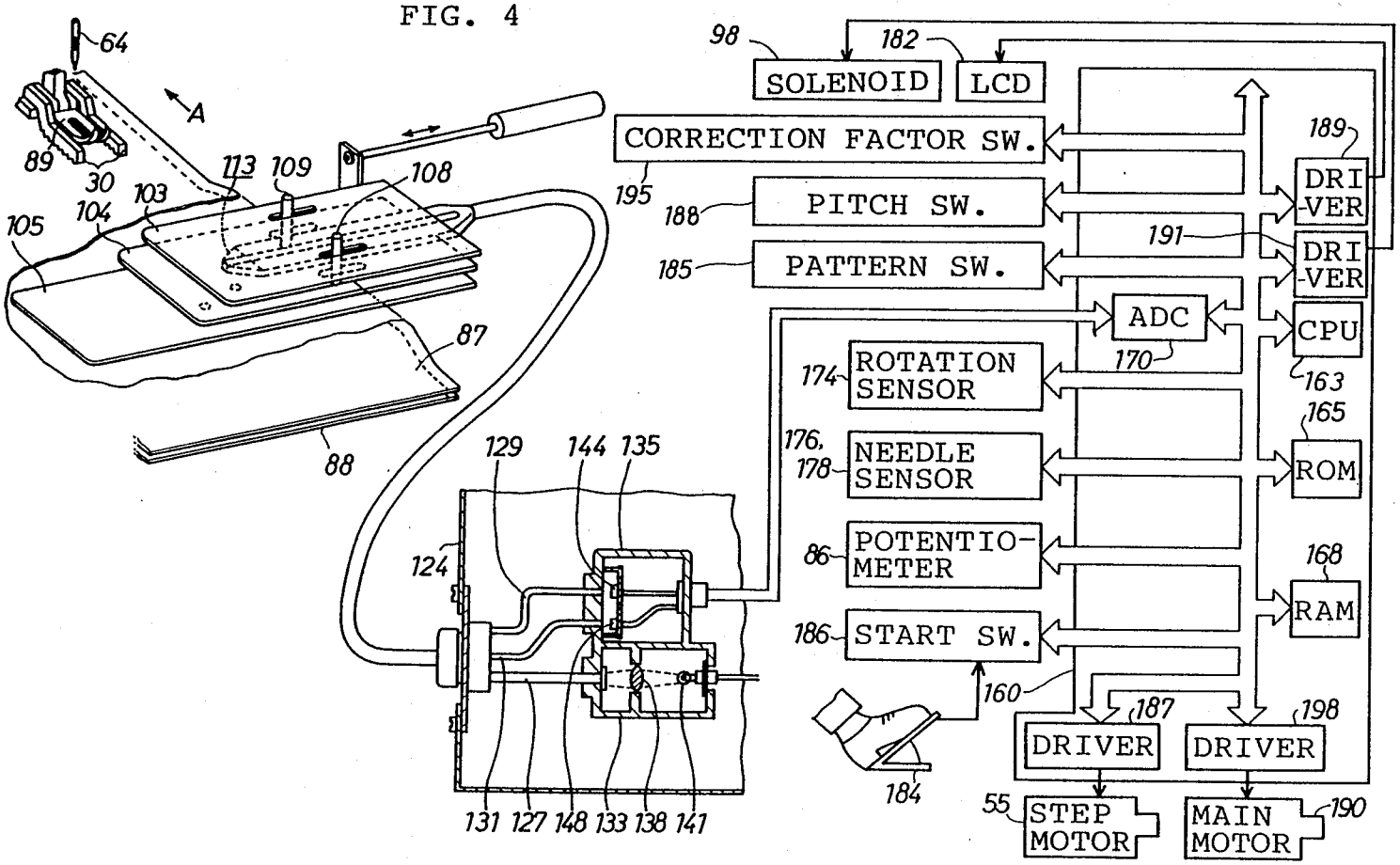
FIG. 4 illustrates the structure of a pattern detector and its control unit.

As shown in FIG. 4, the electronic control unit 160 is a microcomputer including a central processing unit (CPU) 163, read only memory (ROM) 165, random access memory (RAM) 168, an analog-to-digital converter (ADC) 170, and driver circuits 187, 189, 191, and 198. The ADC 170 connects to the photosensors 144 and 148, the driver circuit 187 to the step motor 55 for adjusting the upper feed amount, the driver circuit 189 to a liquid crystal display (LCD) 182 for displaying each set value, the driver circuit 198 to the main motor 190 of the sewing machine 1. The electronic control unit 160 connects to: a rotation sensor 174 on the pulley 15 for generating twenty-four (24) pulse signals per rotation of the main shaft 17; needle position sensors 176 and 178 also in the pulley 15 for generating low-position and high-position signals, respectively; the potentiometer 86 for detecting the lower feed amount; a start switch 186 at a pedal 184 for generating start, stop and thread-cut signals; and a pattern setting switch 185 for setting an initial upper feed amount according to the sewing conditions; a pitch setting switch 188 for setting a reference length L according to the pattern recurring distance; and a correction switch 195 for setting a correction factor G.

Figure 6:
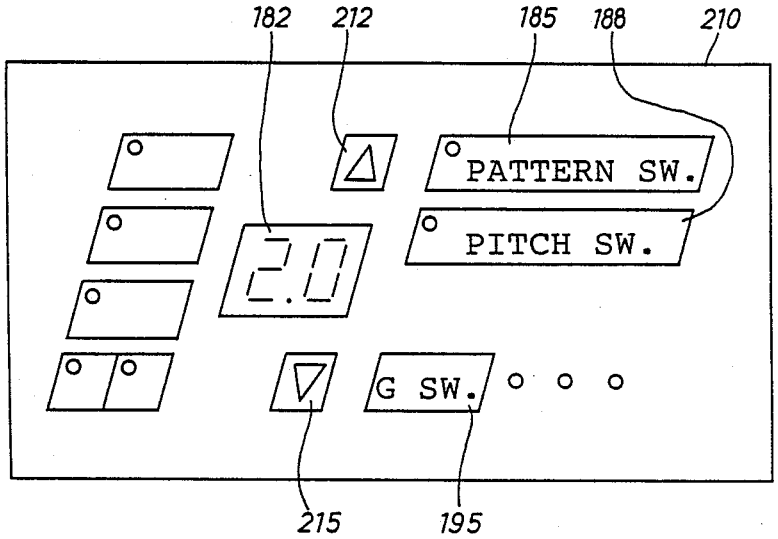
FIG. 6 illustrates a console panel.

A console panel 210 (FIG. 6) includes the above switches 185, 188 and 195, and the LCD 182. The console panel 210 further includes an increment key 212 and a decrement key 215 for changing a value set by the switches 185, 188 and 195. A control routine for pattern matching is stored in the ROM 165. In the RAM 168, data areas corresponding to a reference number Cm are allocated to sequentially store intensity data sensed by the photo-sensors 144 and 148.

The pattern-matching control routine of the sewing machine 1 is now described with reference to the flow charts shown in FIGS. 7A, 7B, 8, 9 and 10.

The values that were previously set by the switches 185, 188, and 195 before the power was turned off are preserved by a backed-up memory, and, when the power of the sewing machine 1 is turned on, the stored values become initial values. When the sewing machine 1 is used for the first time, when it has not been used for a long time, or when different cloths from ones sewn previously are sewn, new values must be set. For example, on pressing the correction switch 195 to set a new correction factor G, a correction-factor number is displayed on the LCD 182. An operator presses the switch 195 and the increment key 212 or the decrement key 215 to select one of three correction factors G1, G2, and G3. Similarly, the operator presses the switch 185 and the key 212 or the other key 215 to set the initial upper feed amount Ho and presses the switch 188 and the key 212 or the other key 215 to set the reference length L. Normally the initial upper feed amount Ho is set so that the actual feed amounts between the upper cloth 87 and the lower cloth 88 are almost equal. The length L is set slightly longer than the longest repeating segment of the pattern, and L should be longer than the longest solid (or unpatterned) segment of the pattern to detect any intensity change.

Figure 11:
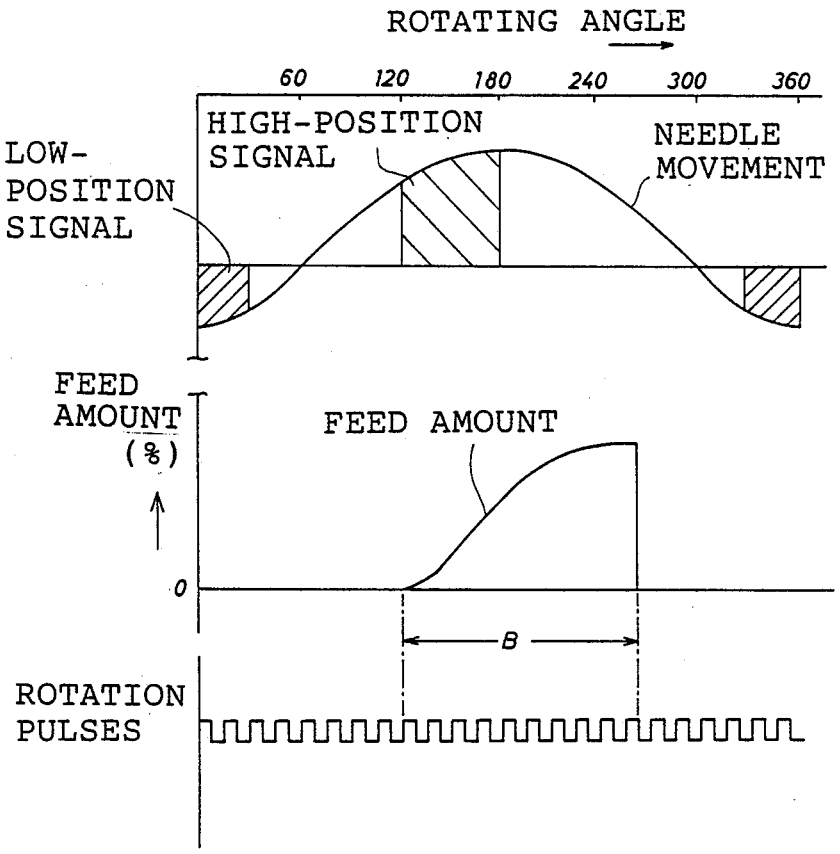
FIG. 11 is a graph illustrating a needle position, feed amount and pulse signals generated by a rotation sensor.
Figure 13A:
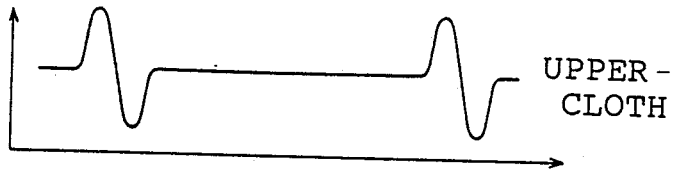
FIGS. 13A and 13B are graphs of the differentiated data for the upper and lower cloths, respectively.
Figure 13B:
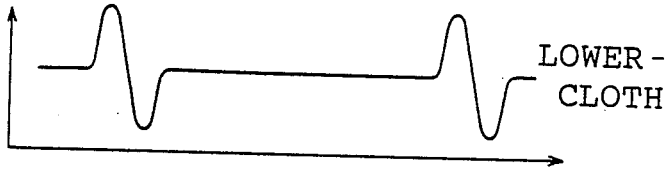

First, the interrupt processing routine (FIG. 10) is explained. This routine is started at every falling edge of the rotation pulse signal from the rotation sensor 174. As shown in FIG. 11, the rotation sensor 174 generates twenty-four (24) pulse signals during a rotation of the main shaft 17, so that each time the main shaft 17 rotates through fifteen (15) degrees, the routine is executed.

In the interrupt processing routine, it is first examined at step S200, whether the pulse signal from the rotation sensor 174 is within a cloth feeding movement (B in FIG. 11). If not, the routine ends. If the pulse signal from the rotation sensor 174 is within the feeding movement, intensity data sensed by the photo-sensors 144 and 148 are converted to digital signals by the ADC 170 and are stored as one set of intensity data in the RAM 168 at step S203. The counter C for the intensity data set is incremented by one at step S206, and this routine ends. Thus the intensity data sets are stored in the preset areas of the RAM 168.

The pattern-matching control routine (FIGS. 7A and 7B) is now explained. This routine is executed at a preset time interval. First the state of the pitch setting switch 188 is examined at step S220. When the switch 188 is not turned on, the length L is not changed and the process goes to step S250. When the switch 188 is turned on, the length L set by the operator is input at step S230, and the reference number Cm is calculated at step S240. The number Cm represents the number of intensity data sets corresponding to the length L, and is calculated as follows:

$$Cm = Np \cdot L/Df,$$

where Np is the number of pulses in the feeding range and Df is the feed amount. For example, when the length L is set at 30 mm and the feed amount is 1 mm, Cm is calculated as 10 (pulses)×30 (mm)/1 (mm)=300, since the number of pulse signals is 10 (pulses) per main shaft rotation in the feeding range.

Subsequently, a control counter K and the counter C for the intensity data sets stored in the RAM 168 are cleared at zero at steps S250 and S260. Then, the CPU 163 waits until the upper and lower cloths 87 and 88 are set and the pedal 184 is pressed at steps S270 and S280, respectively, at which time the CPU 163 drives the main motor 190 to start sewing at step S290. The upper feed amount immediately after the start of sewing is the initial upper feed amount Ho preset by the pattern setting switch 185.

While the main motor 190 rotates during sewing, the interrupt processing routine (FIG. 10) is repeatedly executed and the intensity data sets are sequentially stored in the preset data areas of the RAM 168. When the control counter K is zero and the counter C for intensity data sets is less than the reference number Cm at steps S300 and S310, respectively, the process step returns to step S270, while the sewing continues.

Figure 8:
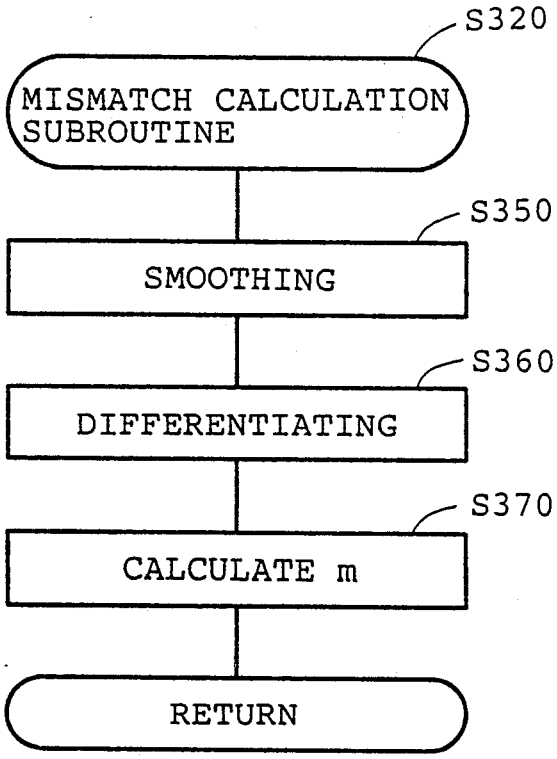
FIG. 8 is a flowchart of a mismatch calculation subroutine.
Figure 9:
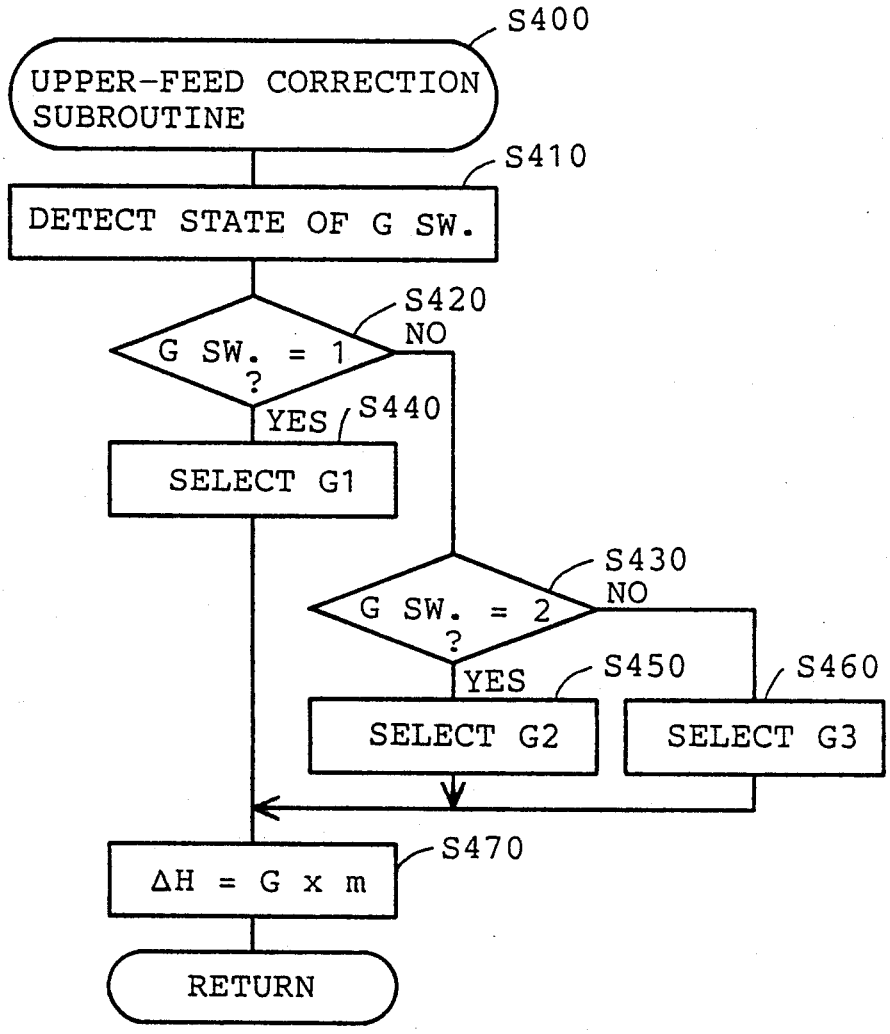
FIG. 9 is a flowchart of an upper-feed correction subroutine.
Figure 10:
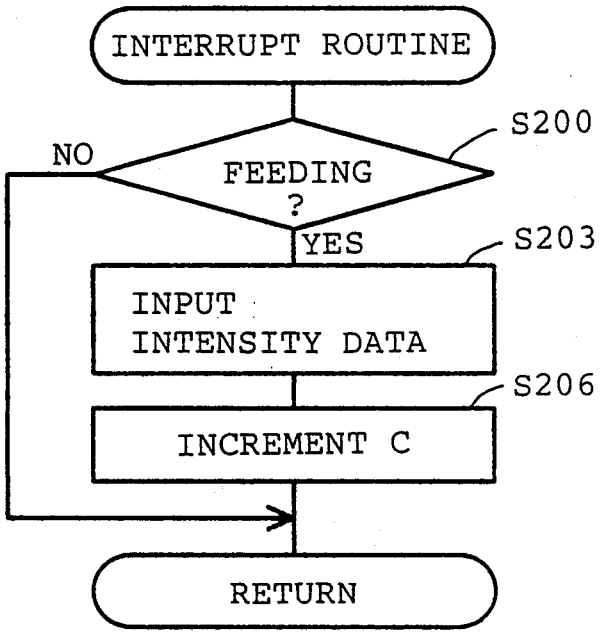
FIG. 10 is a flowchart of an interrupt processing routine.

When the counter K is not equal to zero at step S300, or when the counter C reaches Cm (i.e., when the first Cm data sets are stored) at step S310, the mismatch-distance calculation subroutine is executed at step S320. The subroutine in FIG. 8 is explained, using the upper and lower cloths 87 and 88 having the same pattern shown in FIGS. 12A and 12B.

First, the latest collected Cm sets of intensity data are retrieved from the RAM 168, and a smoothing (averaging) process is performed for every point of each data sequence at step S350. That is, intensity data of 21 points from before and after a point is added to the intensity data of that point, and the sum is divided by 43 (=21+1+21) to obtain the smoothed data for that point. The smoothing process removes influences of noise from the collected intensity data. The results are shown in FIGS. 12C and 12D.

Figure 1:
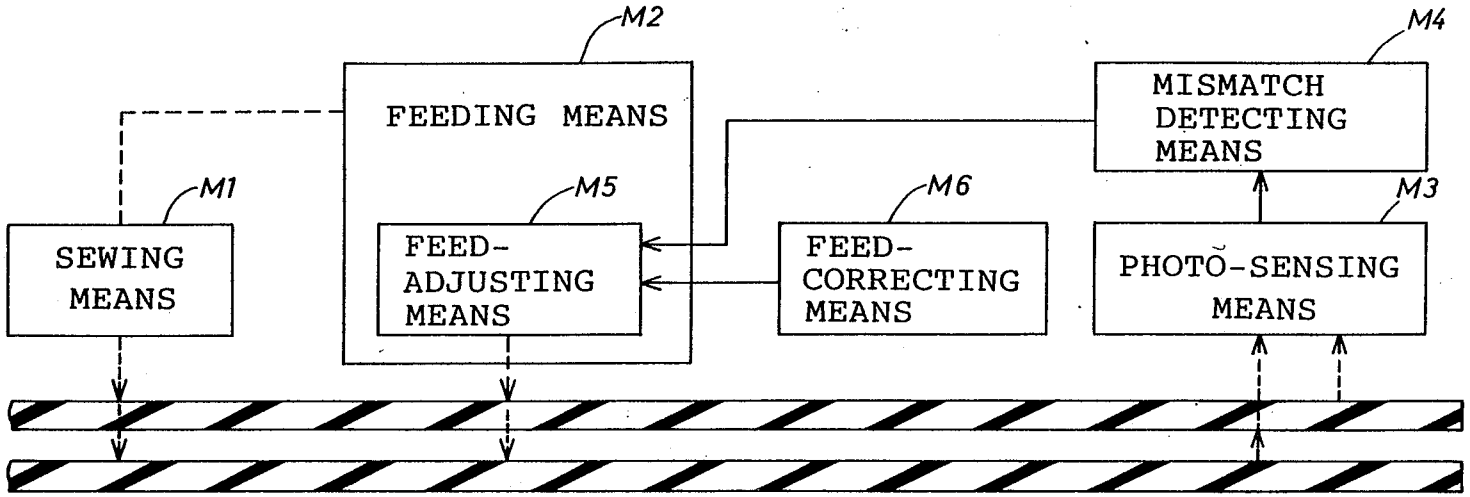
FIG. 1 is a block diagram, illustrating a typical structure of a pattern-matching sewing machine using this invention.

The smoothed data is then differentiated at step S360. The results are shown in FIGS. 1 3A and 1 3B. The differentiating process emphasizes the acute changes and diminishes gentle changes in the smoothed data. Therefore, a gentle peaks caused by the longitudinal stripes are removed.

Figure 14:
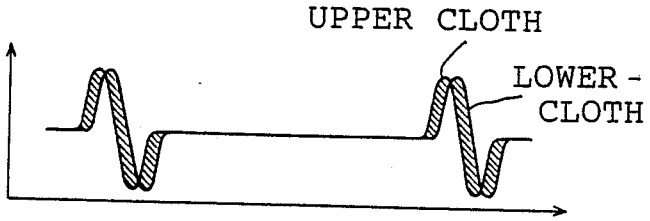
FIG. 14 is a graph showing the superposition of the differentiated-data peaks for the upper and lower cloths.

The differentiated data of either the upper or lower cloth is amplified at a preset rate so that their peak heights between the upper cloth 87 and the lower cloth 88 become equal. An offsetting process for each data of the cloth 87 and 88 is then performed where an average value of all points is subtracted from each point so that the average value for each data of the cloths 87 and 88 becomes zero. The resultant curves of the upper and lower cloths 87 and 88 are superposed as shown in FIG. 14. The curves are relatively shifted to minimize the difference area (shaded in FIG. 14), by which the mismatch direction and distance m are calculated at step S370.

The CPU 163 determines the upper feed amount H not directly from the calculated mismatch distance m, but after executing the upper-feed correction subroutine according to sewing conditions at step S400.

In the upper-feed correction subroutine (FIG. 9), first, the state of the correction switch 195 is detected at step S410. One of the three correction factors G1, G2, and G3 is selected according to the state of the switch 195 at steps S420, S430, S440, S450 and S460. G1, G2 and G3 are set at 0.1, 0.2 and 0.4, respectively. That is, pattern mismatch is overcome by selecting one of these three values according to the species of cloths. The upper-feed change amount ΔH is calculated by multiplying the selected correction factor G by the mismatch distance m at step S470. Then the subroutine ends.

Figure 7A:
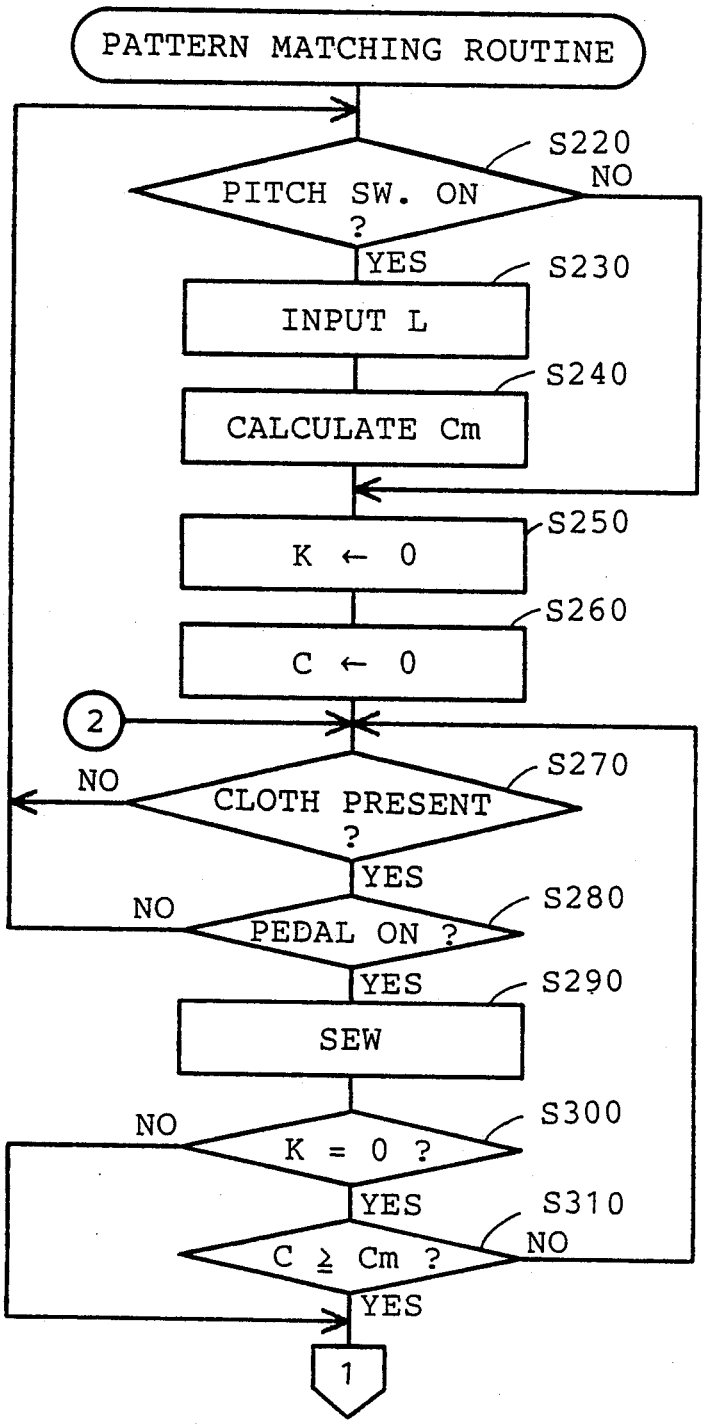
FIGS. 7A and 7B are a flowchart of a pattern-matching control routine.
Figure 7B:
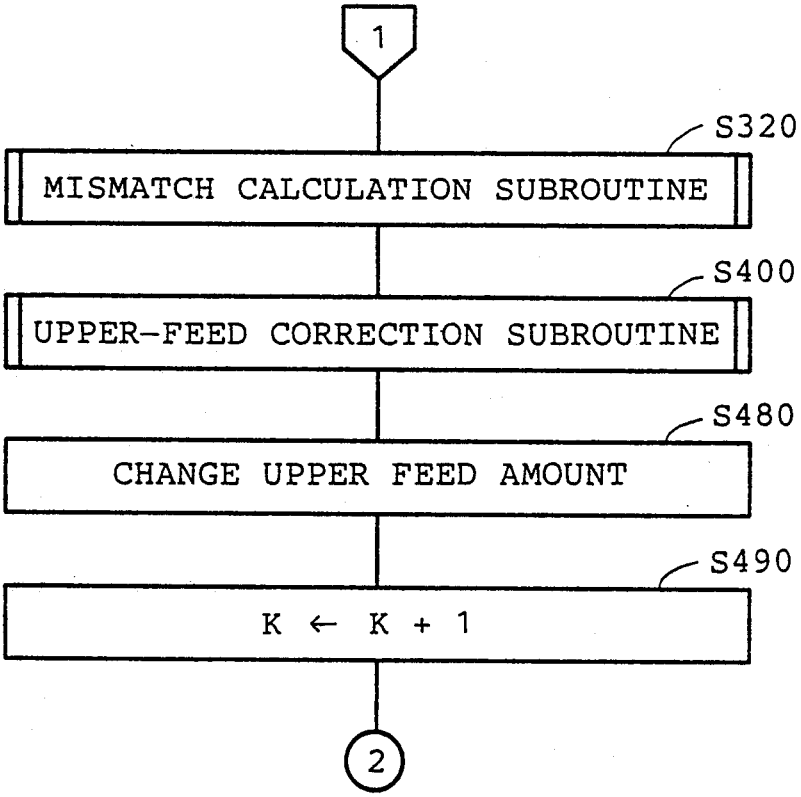

In the main routine, the calculated change amount ΔH is added to or subtracted from the initial upper feed amount Ho according to the mismatch direction. Specifically, if the pattern of the upper cloth 87 is fed more than that of the lower cloth 88, the change amount ΔH is subtracted from the initial upper feed amount Ho. On the other hand, if the pattern of the upper cloth 87 is fed less than that of the lower cloth 88, the change amount ΔH is added to the initial upper feed amount Ho. Thus the next upper feed amount H is determined, and the step motor 55 is driven to adjust the upper feed amount H at step S480 (FIG. 7B).

Figure 17:
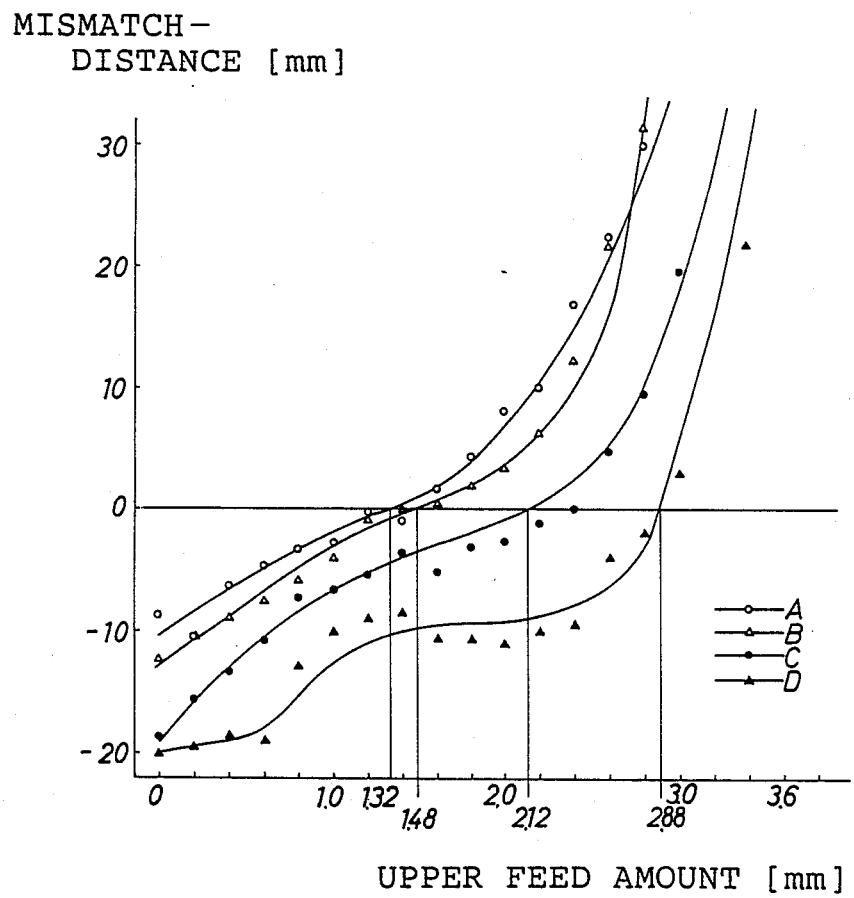
FIG. 17 is a graph showing the mismatch distances according to various species of cloths.

Therefore, even when the mismatch distances m are the same, if the biggest correction factor G3 is selected for thick wool cloth A shown in FIG. 17, the change amount ΔH is given a big value. On the other hand, if the smallest correction factor G1 is selected for thin cloth D, the change amount ΔH is given a small value. In the both cases, the pattern mismatch is removed by feeding the upper cloth 87 ten times or so at the upper feed amount H changed based on the calculated change amount ΔH.

After that, the control counter K is incremented by one at step S490. Then the process step returns to step S270, and the same processes are repeated.

Figure 16A:
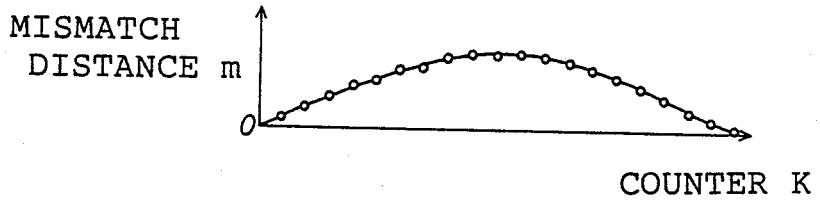
FIGS. 16A, 16B and 16C are graphs showing the change in the mismatch distance.
Figure 16B:
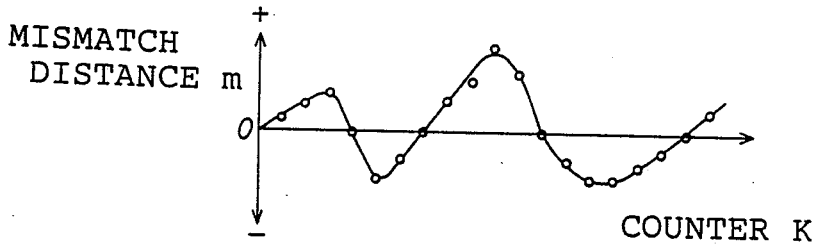
Figure 16C:
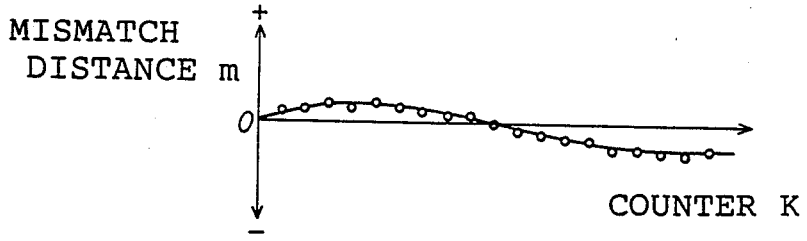

As shown in FIG. 16C, the sewing machine 1 of the embodiment can appropriately sew cloths having the same pattern with the patterns matching by selecting one of the three correction factors, G1, G2, and G3, which are set according to sewing conditions. Therefore, the sewing machine 1 does not need a long distance to restore the matching (FIG. 16A), and avoid a mismatch fluctuation (FIG. 16B). Thus, quality pattern-matched products can be obtained.

Moreover, in this embodiment, since one of three grades is set as the correction factor G, an operator does not have to set a value according to the various sewing conditions (e.g., species of cloths, rotation speed of the main motor 190, shape of the upper feed dog or presser foot, and pressure of the presser foot).

A pattern-matching sewing machine 1 of the second embodiment is set forth below.

The pattern-matching sewing machine 1 of the second embodiment is same as the pattern-matching sewing machine 1 of the first embodiment except that the correction switch 195 is removed and the upper-feed correction subroutine (step S400) is modified.

Figure 15:
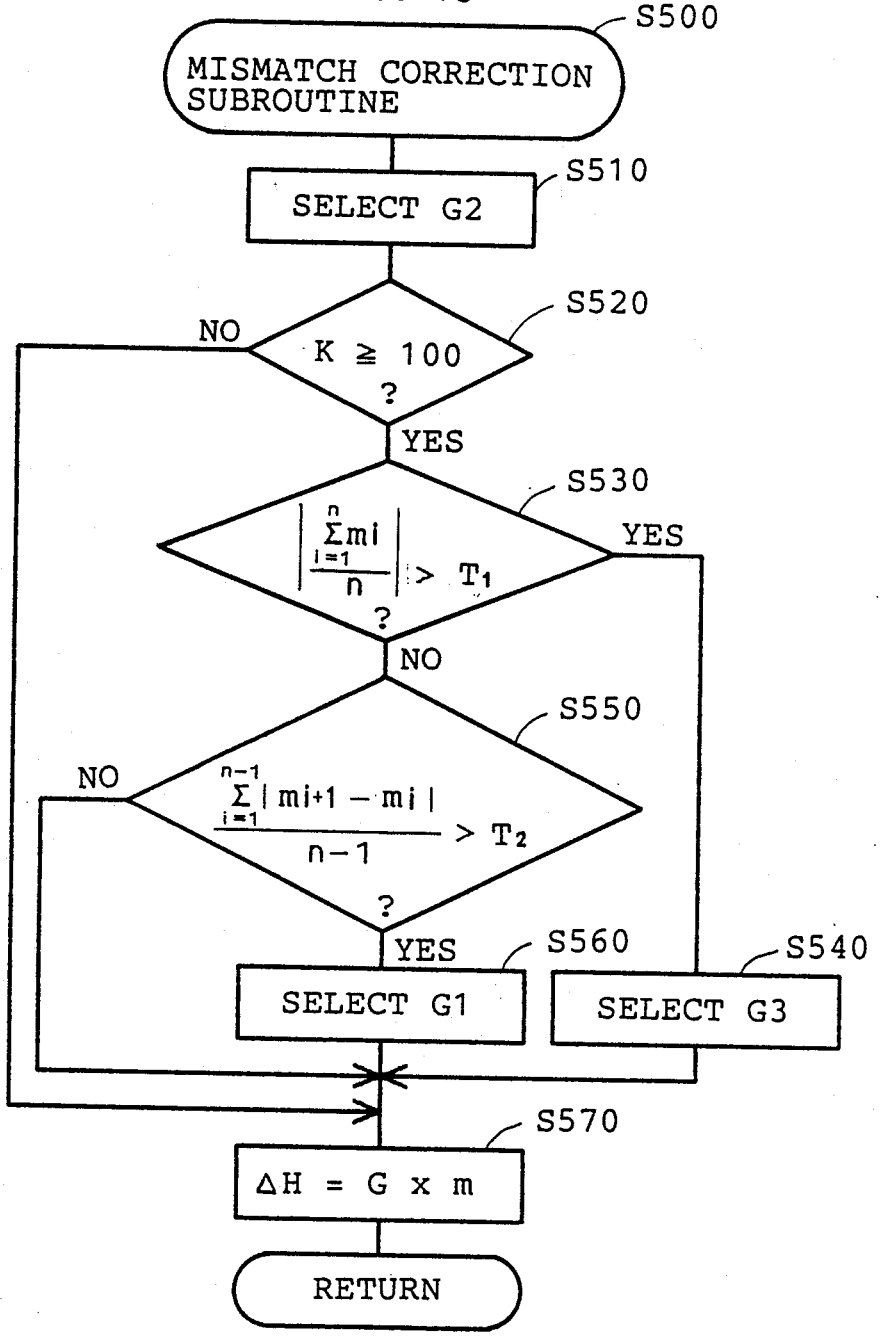
FIG. 15 is a flowchart of a mismatch correction subroutine in the second embodiment.

In this sewing machine 1, the correction factor G is not preset but is automatically set in the mismatch correction subroutine (step S500) shown in FIG. 15. In this subroutine, the CPU 163 first selects a correction factor G2 at step S510.

When the control counter K is less than 100 at step S520, the correction factor G2 is maintained. When the counter K exceeds 100 at step S520, the latest collected mismatch distances m of the number n (n=20 in this embodiment) are added together, and the sum is divided by the number n. Then it is examined at step S530 whether the absolute value of the quotient S1 exceeds a preset value T1

(1 mm in this embodiment).

When S1>T1, the CPU 163 determines that a long-distance sewing is necessary to return the mismatch distance m to zero, and changes the correction factor G from G2 to G3 at step S540.

On the other hand, when S1<T1, the change amount is calculated by subtracting every mismatch distance by the previous mismatch distance. The absolute values of (n−1) such change amounts values are added, and the sum is divided by the number (n−1). It is examined at step S550 whether the quotient S2 exceeds a preset value T2 (0.5 mm in this embodiment).

When S2>T2, the CPU 163 determines that a mismatch fluctuation has occurred (FIG. 16B), and changes the correction factor G from G2 to G1 at step S560. When S2<T2, the CPU 163 determines that a correct pattern-matching sewing is executed, and maintains the correction factor G2. At step S570, in the same way as the first embodiment, the upper-feed change amount ΔH is calculated by multiplying the correction factor G by the mismatch distance m. Then the subroutine ends.

As explained above, according to the pattern-matching sewing machine 1 of the second embodiment, the correction factor G is automatically selected without setting the optimum correction factor G in advance. Therefore, even when an operator do not know the optimum correction factor G, the appropriate pattern-matching sewing is executed.

The optimum correction factor G may be selected by a trial sewing.

This invention is not limited to the details of above embodiments and various changes and modifications are possible without departing from the spirit and scope of the invention.

What is claimed is:

1. A pattern-matching sewing machine comprising:

a sewing means for sewing two sheets having the same pattern;

first and second feeding means, each for intermittently feeding one of the sheets;

first and second photo-sensing means, each for optically sensing the pattern on one of the sheets during feeding and for generating photo-intensity data at a plurality of points on the sheet;

a mismatch detecting means for calculating mismatch distances of patterns on the two sheets from the data sensed by the first and second photo-sensing means;

a feed-adjusting means for adjusting amounts fed by at least one of the feeding means based on the calculated mismatch distance to match the patterns; and a feed-correcting means for correcting the feed amount adjusted by the feed-adjusting means according to sewing conditions.

2. A pattern-matching sewing machine as claimed in claim 1, where the feed-correcting means corrects the feed amount according to species of cloths or sewing speed.

3. A pattern-matching sewing machine as claimed in claim 1, where the feed-correcting means adds the previously selected feed amount to or subtracts the previously selected feed amount from the current feed amount.

4. A pattern-matching sewing machine as claimed in claim 1, where the feed-correcting means adds the correction amount selected automatically by feedback control to or subtracts the correction amount selected automatically by feedback control from the feed amount.

* * * * *